United States Patent [19]

Nordgren

[11] 3,938,746

[45] Feb. 17, 1976

[54] PRE-TEARING DEVICE FOR DRY PLATES OF WOOD PULP

[75] Inventor: Gunnar Nordgren, Helsinki, Finland

[73] Assignee: Oy Suomen Vanutehdas - Finwad Ltd., Helsinki, Finland

[22] Filed: Oct. 22, 1974

[21] Appl. No.: 516,927

[30] Foreign Application Priority Data

Dec. 21, 1973 Finland ..... 3956/73

[52] U.S. Cl. ..... 241/186 R; 241/189 R; 241/280; 241/294

[51] Int. Cl.[2] ..... B02C 18/14; B02C 18/22

[58] Field of Search ..... 241/186 R, 189 R, 223, 241/242, 277, 280, 293, 294

[56] References Cited

UNITED STATES PATENTS

| | | | |
|---|---|---|---|
| 1,013,509 | 1/1912 | Nelson | 241/242 |
| 2,150,984 | 3/1939 | Near et al. | 241/223 X |
| 2,559,701 | 7/1951 | Becker | 241/280 X |
| 3,436,028 | 4/1969 | Koehhen | 241/186 R |
| 3,825,192 | 7/1974 | Knight | 241/223 X |

*Primary Examiner*—Granville Y. Custer, Jr.
*Assistant Examiner*—Howard N. Goldberg
*Attorney, Agent, or Firm*—Ladas, Parry, Von Gehr, Goldsmith & Deschamps

[57] ABSTRACT

A pre-tearing device for producing coarse flour out of bale plates of flake-dried wood pulp. The pre-tearing device comprises a feeding device for the plates and a rotating cylinder the surface of which is provided with spikes. The feeding device is arranged to feed the plates to be torn against the surface of the tearing cylinder in a direction that deviates from a direction perpendicular to the surface of the tearing cylinder. The spikes are arranged on the cylinder surface as two spirals rotating in opposite directions in relation to each other.

6 Claims, 3 Drawing Figures

PRE-TEARING DEVICE FOR DRY PLATES OF WOOD PULP

FIELD OF INVENTION

The present invention relates to a pre-tearing device for producing a coarse flour, for example, out of bale plates of flake-dried wood pulp by pre-tearing, which pre-tearing device comprises a feeding device for the plates and a rotating tearing cylinder which carries out the tearing work proper and whose surface is provided with spikes.

When using such a pre-tearing device, is is possible, by Pre-tearing of bale plates of flake-dried wood pulp, to obtain a coarse flour which is suitable for being mixed, for example, in the pre-torn pulp mix mentioned in copending Patent Application Ser. No. 516928 filed Oct. 22, 1974 and for being transported by centrifugal blowers and in pipe systems and for separation with a high efficiency in cyclones.

BACKGROUND OF THE INVENTION

Previously, one has not systematically aimed at such a construction of a pre-tearing device for flake-dried pulp bale plate that the obtained pre-flour were as uniform and coarse as possible. This is why only some general solutions can be mentioned, such as chaff cutters (German Zerspaner), tearing devices for paper waste, etc. In these general solutions, remarkable machine powers are required, such as 50 kW. Frequently there is a bottom screen in general machines, such as in tearing devices for paper waste, for which reason there is often a considerable extent of dust at the machine because the material to be ground rolls around in the machine several times until it escapes through the bottom screen as having become sufficiently small.

A purpose of the present invention is to eliminate the above drawbacks and to provide a highly efficient pre-tearing device for bale plates. The pre-tearing device in accordance with the invention is mainly characterized in that the feeding device is arranged so as to feed the plates to be torn against the surface of the tearing cylinder in a direction that deviates from the perpendicular direction, and the spikes have been applied onto the cylindrical surface of the cylinder as two spirals rotating in opposite directions in relation to each other.

BRIEF DESCRIPTION OF THE DRAWINGS

The pre-tearing device in accordance with the invention will be described, by way of example, with reference to the attached drawings, in which.

DESCRIPTION OF THE PREFERRED EMBODIMENT

Figure 1:
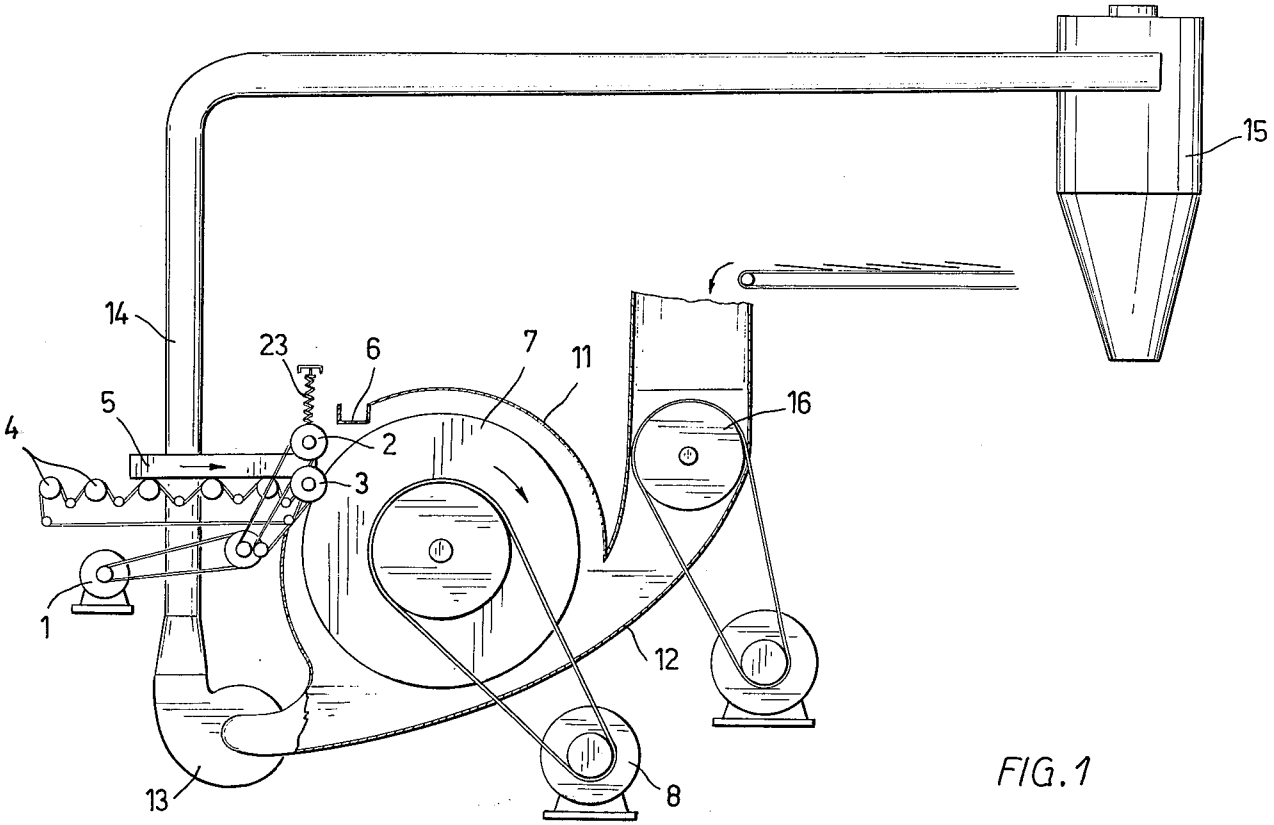
FIG. 1 shows a partly schematical view of an embodiment of the pre-tearing device in accordance with the invention.

In accordance with FIG. 1, the feeding motor 1 operates, by means of transmission systems, corrugated feeding rollers 2 and 3. The upper feeding roller 2 is loaded by springs 23 and can spring upwards 20 mm in the vertical direction. In other words, between the bearings of the feeding rollers 2 and 3 there is an approximately 80 mm intermediate lifting space.

The feeding motor 1 also operates smooth-surface rollers 4 by chain transmission. The peripheral velocity of the rollers 4 is considerably (e.g. 4 times) higher than the peripheral velocity of the feeding rollers 2 and 3.

A bale plate 5 consisting of flake-dried mechanical wood pulp (e.g. 1/5 of a bale = 1/5 × 200 kg = 40 kg/plate), which is approximately 100 mm thick and, e.g., 600 mm wide and 700 mm long, penetrates by the friction force of the rollers 4 into the feeding roller mouth 2, 3, whereby the feeding roller 2, as loaded by a spring 23, climbs up on the edge of the plate 5 and the feeding starts. The motor 8 operates the tearing cylinder 7 (e.g., $n = 300$ rpm, the motor 8 power P being = 7 kW). The surface of the cylinder 7 has a spike system, which will be described separately below. The diameter of the cylinder 7 is $d = 1000$ mm. The spikes tear the edge of the bale plate 5 fed in a direction that deviates from a direction perpendicular to the surface of cylinder 7. More specifically, the angle between the feeding direction of the plate and the radius of the cylinder, at the point where the spikes hit the front end of the plate, is in the range of 15 to 35°. According to measurements, the optimum angle is 19.7°, when the hitting point is defined as situated mid-way of the thickness of the plate.

This angle is advantageous, because then the bale itself tends to move in the feeding direction over its entire width, and no backward impacts are directed at the feeding rollers 2, 3.

Also, the power requirement is lower than in the case that the plate 5 were fed perpendicularly against the cylinder 7 surface, because in the plate 5 the fibre layers are in the horizontal plane more than in the vertical plane.

The plate edge ground in this way partly bends upwards until it meets an obstacle 6, which is U-beam, at the bottom face of which zig-zag weldings have been applied as deposits, which "bite" into the top part of the flake plate 5.

Although the grinding takes place mainly in the plane of the flake plate 5, the pre-crushing of larger pieces becoming loose from the plate, such as the end piece of the plate, takes place underneath the beam 6.

Figure 2:
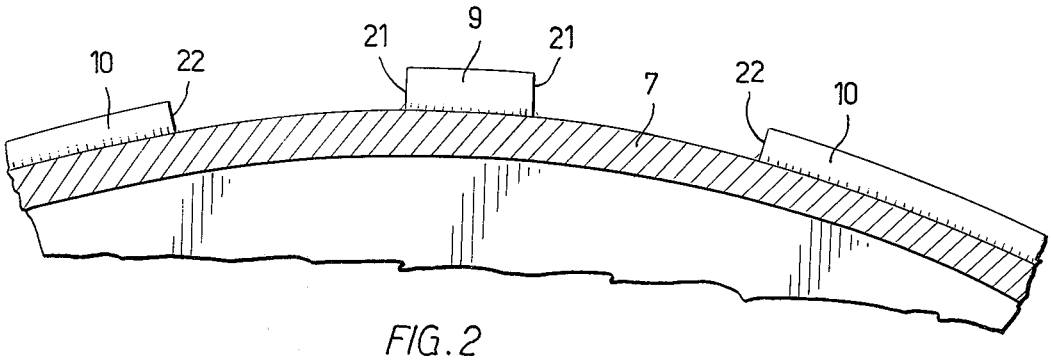
FIG. 2 shows a part-sectional detail of the tearing cylinder of the pre-tearing device according to FIG. 1 on an enlarged scale.
Figure 3:
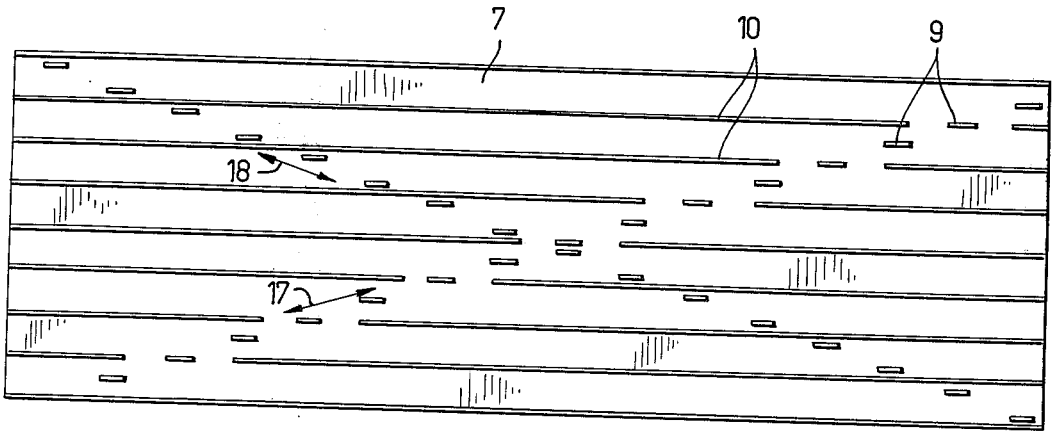
FIG. 3 shows a schematical view of the spike system of the cylinder in accordance with FIG. 2 with the surface of the cylinder as unrolled.

The spike system of the cylinder 7 will now be described with reference to FIGS. 2 and 3.

When examining the splitting characteristics of a flake-dried plate, it has been noticed that 6 mm wide blades, whose spacing is 25 mm in respect of the cylinder width, split the plate evenly.

Along the circumferential surface of the cylinder 7, two interlapping helices 17 and 18 of spikes extending in opposite directions in relation to each other have been distributed, each of them with a lateral spike spacing of 50 mm. The helices are disposed in relation to each other so that the right and the left half of the front end of the plate always receive spike contact simultaneously, whereby the plate does not vibrate in the lateral direction when it is worked. The said interlapping spike rows, each of them with a lateral spacing of 50 mm, form a joint spike system with a lateral spacing of 25 mm, which spike system evenly splits coarse fibre flakes out of the plate. The height of each spike 9 is 15 mm, thickness 6 mm and length 50 mm. Associated with every fourth spike is a 12 mm high and 6 mm thick band 10, which has been fastened by welding around the cylinder circumference. Between each band and its associated spike is a space, in front of and behind the spike, of 100 mm.

The cutting edges 21 of the spikes and the leading edges 22 of the bands have been welded by manganese electrode rod onto the body material, which can be, for example, of St 37 steel.

The bands 10 prevent loosened larger pieces, at the nominal peripheral velocity, from falling to the root of the spike and from hereafter blocking the machine or from being separated as excessively large pieces in view of the desired uniform quality. Thus, these bands are laterally spaced at 100 mm in relation to the cylinder width, i.e. one band in connection with every second spike of one helix (i.e. 18). The other helix of spikes 9 are identical but are without said bands.

When the peripheral velocity of the two rollers 2, 3 driven by the motor 1 (FIG. 1) has been arranged so that the feed is, for example, 1, 2, or 3 mm per revolution, the corresponding production capacity for the machine obtained is P = 1000 to 3000 kg/h. The production capacity can be increased easily by increasing the rotating speed of the motor and the feeding speed. The flakes are hurled from the top cover 11 to the bottom cover 12 and proceed from there further into the centrifugal blower 13 and through the pipe system 14 into the cyclone 15.

The pre-tearing device is designed so that on it it is possible to include a cutter mill 16 or a similar mill, known per se, in which other additives can be ground for mixing in.

The pre-tearing machine in accordance with the invention has been intended primarily for use in the production of products of the hygienic field, and the first chaff obtained from the machine is intended to be fed further into intermediate distributors, mixers, hammer mills, plate mills, and grinding devices.

I claim:

1. A pre-tearing device for producing a coarse flour from bale plates of flake-dried wood pulp, comprising:

a. a tearing cylinder arranged for rotation about an axis of rotation;

b. a plurality of spikes arranged on the cylindrical surface of the tearing cylinder as two helices extending in opposite directions in relation to each other, the distance between adjacent spikes of each helix being in the axial direction of the tearing cylinder, several times bigger than the width of each spike;

c. a plurality of bands extending circumferentially around the cylinder in a parallel relationship with each other, the distance between adjacent bands, in the axial direction of the tearing cylinder, being several times bigger than the width of each band;

d. means for feeding the bale plates to the rotating cylinder such that the angle between the feeding direction of the plates and the radius of the cylinder, at the point where the front end of the plates engages the cylindrical surface of the tearing cylinder, is in the range of 15 to 35°; and e. a wedge means arranged in parallel with the axis of the tearing cylinder at a distance, from the feeding point in the direction of said rotation of the cylinder, and spaced a distance radially from the cylindrical surface of the tearing cylinder for grinding larger loose pieces of bale plates.

2. A pre-tearing device as claimed in claim 1, wherein the spikes in the two helices are arranged so as to interlap each other in the axial direction of the tearing cylinder such that adjacent spikes each belong to a different helix.

3. A pre-tearing device as claimed in claim 1, wherein the wedge means is a U-beam.

4. A pre-tearing device as claimed in claim 1, wherein each band has an interrupted space in its circumference.

5. A pre-tearing device as claimed in claim 4, wherein in each interrupted space is disposed a said spike.

6. A pre-tearing device as claimed in claim 5, wherein the spikes in the interrupted spaces all belong to the same helix.

* * * * *